US005600890A

United States Patent [19]

Leitner et al.

[11] Patent Number: 5,600,890

[45] Date of Patent: Feb. 11, 1997

[54] HAIR-CUTTING APPARATUS HAVING A TOOTHED CUTTING DEVICE AND METHOD OF MANUFACTURING A CUTTER FOR A TOOTHED CUTTING DEVICE OF SUCH APPARATUS

[75] Inventors: Stephan Leitner, Kappel; Josef Ribitsch, Ferlach, both of Austria

[73] Assignee: U.S. Philips Corporation, New York, N.Y.

[21] Appl. No.: 336,616

[22] Filed: Nov. 9, 1994

[30] Foreign Application Priority Data

Nov. 10, 1993 [AT] Austria ..... 2283/93

[51] Int. Cl.[6] ..... B26B 19/06

[52] U.S. Cl. ..... 30/223; 30/210; 72/340; 76/116; 76/DIG. 8

[58] Field of Search ..... 30/34.1, 195, 208, 30/209, 200, 210, 215, 216, 346.56, 223; 76/106.5, 116, DIG. 8; 72/325, 326, 330, 332, 337, 340

[56] References Cited

U.S. PATENT DOCUMENTS

| | | | |
|---|---|---|---|
| 2,713,718 | 7/1955 | Hudson | 30/210 |
| 2,875,519 | 3/1959 | Andis | 30/210 |
| 3,166,957 | 1/1965 | Biesma | 72/340 |
| 4,106,190 | 8/1978 | Buras, Jr. et al. | 30/216 |
| 4,118,863 | 10/1978 | Sandy | 30/195 |
| 4,941,259 | 7/1990 | Wolf | 30/34.1 |
| 5,054,199 | 10/1991 | Ogawa | 30/34.1 |

FOREIGN PATENT DOCUMENTS

| | | |
|---|---|---|
| 0325326 | 7/1989 | European Pat. Off. . |
| 2809345 | 1/1979 | Germany . |

*Primary Examiner*—Hwei-Siu Payer
*Attorney, Agent, or Firm*—Ernestine C. Bartlett

[57] ABSTRACT

A hair-cutting apparatus has a toothed cutting device comprising a stationary cutter with a row of cutter teeth and a reciprocable cutter with a row of cutter teeth, the cutter teeth of at least one of the two cutters are rounded at their distal ends except for the area of their shearing faces and in addition are wholly rounded over their entire tooth depth into the proximal tooth area except for the area of their shearing faces.

16 Claims, 4 Drawing Sheets

HAIR-CUTTING APPARATUS HAVING A TOOTHED CUTTING DEVICE AND METHOD OF MANUFACTURING A CUTTER FOR A TOOTHED CUTTING DEVICE OF SUCH APPARATUS

BACKGROUND OF THE INVENTION

The invention relates to a hair-cutting apparatus having a toothed cutting device comprising a stationary cutter with at least one row of cutter teeth and a reciprocatingly drivable cutter with at least one row of cutter teeth, the cutter teeth having sheafing faces and the two cutters being in engagement with one another by at least a part of the shearing faces of their cutter teeth, and the cutter teeth of at least one of the two cutters being rounded at their distal ends except for the area of their shearing faces.

An apparatus of the type defined in the opening paragraph is known, for example from DE 28 09 345 A1. The known apparatus is a hair-trimmer for thinning out hairs during hair-cutting. In this known apparatus the distal ends of the cutter teeth of the reciprocable cutter are rounded and polished. However, adjacent the rounded portions and extending into the proximal tooth areas, at the sides remote from the shearing faces of the cutter teeth, the cutter teeth of the reciprocable cutter have sharp edges as formed during the punching operation used in the manufacture of this cutter. These sharp edges may give rise to scratching and irritation of the skin as the cutter teeth move over the skin, which is an unpleasant and annoying experience for the user of the apparatus and is therefore undesirable and inconvenient.

SUMMARY OF THE INVENTION

It is an object of the invention to mitigate the above problems and to construct a hair-cutting apparatus of the type defined in the opening paragraph so as to preclude scratching and irritation as the toothed cutting device of the apparatus is moved over the skin. For this purpose the invention is characterised in that the cutter teeth of at least one cutter has cutter teeth which are rounded at their distal wholly rounded over their entire tooth depth into the proximal tooth areas except for the area of their shearing faces. Thus, it is very simply achieved that, apart from the area of their shearing faces, where the cutting edges of the cutter teeth are situated, the cutter teeth of the apparatus in accordance with the invention have no sharp edges at all because, except for the area of their shearing faces, the cutter teeth are wholly rounded from the distal ends into the proximal tooth areas. This precludes scratching and skin irritation by the wholly rounded cutter teeth of the toothed cutting device, so that a hair-cutting apparatus in accordance with the invention always provides a gentle cutting performance.

In a hair-cutting apparatus in accordance with the invention, in which owing to the construction of the apparatus only one of the two cutters can contact the skin, only this one cutter should be provided with wholly rounded teeth in accordance with the invention. However, often both cutters of a toothed cutting device can come into contact the skin. In this respect it has therefore proved to be advantageous if the cutter teeth of both cutters are wholly rounded over their entire tooth depth into the proximal tooth areas except for the area of their shearing faces. This ensures that neither of the two cutters can have an adverse effect on the skin.

A cutter having wholly rounded cutter teeth in accordance with the invention may be manufactured, for example, in a metal casting process. Moreover, such a cutter may be manufactured in such a manner that first of a all a cutter blank is produced in a punching operation, after which the wholly rounded cutter teeth are formed in, for example an etching process or by laser-trimming. It has proved to be particularly advantageous if both cutters are formed by punched metal parts and the cutter teeth are rounded in an embossing process. Such cutters are particularly cheap because they can be manufactured in a simple punching process followed by an equally simple embossing process.

According to the invention, a method of manufacturing a cutter for a hair-cutting apparatus in accordance with the invention is characterised in that an unhardened steel strip having a given strip thickness D is moved stepwise to a follow-on tool arrangement and in that a first follow-on step the steel strip is pre-embossed to form pre-embossed first cutter-tooth blanks of a cutter, which pre-embossed first cutter-tooth blanks remain connected to one another by steel-strip bridges formed during pre-embossing and having a small bridge thickness d in relation to the strip thickness D, and in that subsequently in a second follow-on step the strip-steel bridge connecting the pre-embossed first cutter-tooth blanks is cut away in a cutting operation and at the same time second cutter-tooth blanks of a cutter are formed from the first cutter-tooth blanks, and in that subsequently in a third follow-on step the second cutter-tooth blanks are post-embossed to produce post-embossed third cutter-tooth blanks of a cutter, during which post-embossing the third cutter-tooth blanks are embossed so as to be wholly rounded over their entire tooth depth from their distal ends into the proximal tooth areas except for the areas intended for the formation of the shearing faces of the cutter teeth. By pre-embossing the first cutter-tooth blank it is achieved that cutters with cutter teeth having a cutter-tooth width of, for example, only 0.4 mm can be manufactured from comparatively thick steel strip having a strip thickness D of, for example, 1.0 mm. By pre-embossing the first cutter-tooth blanks and post-embossing the second cutter-tooth blanks to produce the third cutter-tooth blanks it is achieved that the wholly rounded shape of the cutter teeth from the distal tooth ends into the proximal tooth area is obtained in a very simple and cheap manner in an embossing process.

In such a method in accordance with the invention it has proved to be favourable if a steel-strip bridge having a bridge thickness d equal to at the most 75% of the strip thickness D is formed during pre-embossing in the first follow-on step. This is favourable for correctly cutting out the second cutter-tooth blanks.

It has proved to be particularly favourable if a steel-strip bridge having a bridge thickness d equal to at the most 30% of the strip thickness D is formed during pre-embossing in the first follow-on step. This is favourable for correctly cutting out the second cutter-tooth blanks and for the manufacture of particularly fine cutter teeth.

It has also proved to be advantageous if after the third follow-on step in the follow-on tool arrangement the resulting cutter blank including its third cutter-tooth blanks is hardened in a further process step. In this way particularly hard cutters having very hard and wear-resistant cutting edges can be obtained. Hardening raises the elastic limit of the cutter material, which precludes undesirable plastic deformations of the cutter.

It has also proved to be very advantageous if the third cutter-tooth blanks of a cutter are ground to form well-defined shearing faces and sharp cutting edges in the area intended for the formation of the shearing faces of the cutter teeth. Grinding the shearing faces in this way is very cheap. However, it is also possible to lap the sheafing faces.

DESCRIPTION OF THE PREFERRED EMBODIMENTS

The invention will now be described in greater detail with reference to the figures of the drawings.

Figure 1:
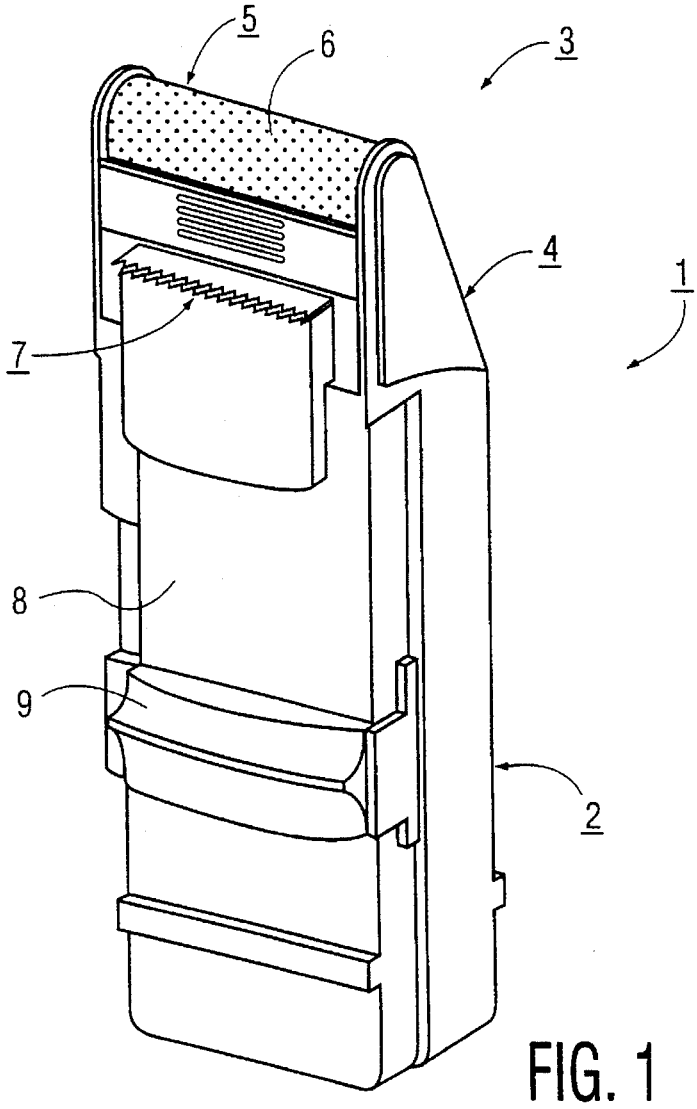
FIG. 1 is an oblique view of a shaving apparatus in accordance with an exemplary embodiment of the invention, comprising a short-hair cutting device and a long-hair cutting device.

FIG. 1 shows a shaving apparatus 1 for cutting hairs. The shaving apparatus 1 has a housing 2 on which a shaving head 3 is mounted. The shaving head 3 comprises a shaving-head frame 4 in which a short-hair cutting device 5 for cutting facial hairs is mounted. The short-hair cutting device 5 basically comprises an arched shear foil 6 and a lamellar cutter which is not shown in FIG. 1 and which is resiliently urged into the interior of the arched shear foil 6. The shaving apparatus 1 further comprises a long-hair cutting device formed by a toothed cutting device 7 for cutting long facial hairs as well as the hairs of the head. The toothed cutting device 7 is mounted at the location of a side wall 8 of the housing 2 so as to be movable in the longitudinal direction of the apparatus 1 between a rest position shown in FIG. 1 and an operating position not shown in FIG. 1, which operating position is situated closer to the short-hair cutting device 5. The shaving apparatus 1 has a sliding button 9 for moving the toothed cutting device 7.

Figure 2:
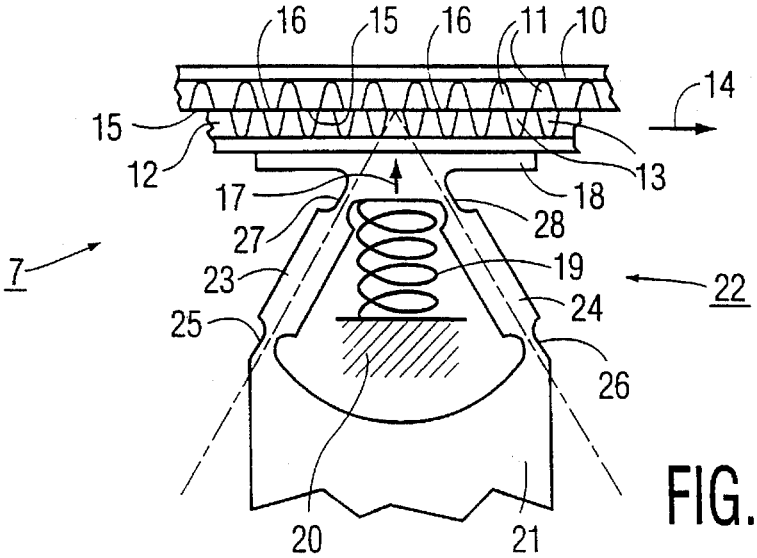
FIG. 2 shows diagrammatically a long-hair cutting device, as used in the apparatus shown in FIG. 1 and constructed as a toothed cutting device with a reciprocable toothed cutter and a toothed cutter which is stationary relative to the reciprocable toothed cutter.

FIG. 2 shows diagrammatically the toothed cutting device 7 of the shaving apparatus shown in FIG. 1. The toothed cutting device 7 has a stationary first cutter 10 constructed as a toothed cutter comprising a row of cutter teeth 11 and stationarily mounted on a support, not shown, for the entire toothed cutting device 7. The toothed cutting device 7 further comprises a reciprocable second cutter 12, which is also constructed as a toothed cutter comprising a row of cutter teeth 13 and which is reciprocatingly drivable parallel to a driving direction indicated by an arrow 14. The cutter teeth 11 of the stationary toothed cutter 10 have shearing faces 15 and the cutter teeth 13 of the reciprocable cutter 12 have shearing faces 16. The two cutters are in engagement with one another at least by a part of the shearing faces 15 and 16 of their cutter teeth 11 and 13. The stationary cutter 10 and the reciprocable cutter 12 are pressed against one another with the shearing faces 15 and 16 of their cutter teeth 11 and 13 parallel to a pressing direction indicated by a further arrow 17. The reciprocable cutter 12 is supported by a cutter holder 18, which is acted upon by a pressure spring 19 which bears against a stationary abutment 20 on the support for the entire toothed cutting device 7. The two rows of cutter teeth 11 and 13 of the toothed cutters 10 and 12 have a different tooth pitch.

A reciprocatingly drivable drive member 21 has been provided for driving the reciprocable cutter 12 and is, for example, formed by a pivotable drive lever. A hinge device 22 is arranged between the drive member 21 and the reciprocable cutter 12 or the cutter holder 18 carrying the toothed cutter 12, via which hinge device a driving force can be transmitted from the drive member 21 to the reciprocable toothed cutter 12, substantially in the area of the point of application of the resultants of the frictional forces between the two cutters 10 and 12. The hinge device 22 comprises two limbs 23 and 24 which are oppositely inclined relative to the pressing direction 17 and which are each connected to the drive member 21 by hinges 25 and 26, respectively, and to the cutter holder 18 by hinges 27 and 28, respectively. The drive member 21, the limbs 23 and 24, and the cutter holder 18 form an integral plastics part, the hinges 25, 26, 27 and 28 being constructed as integral hinges.

Figure 3:
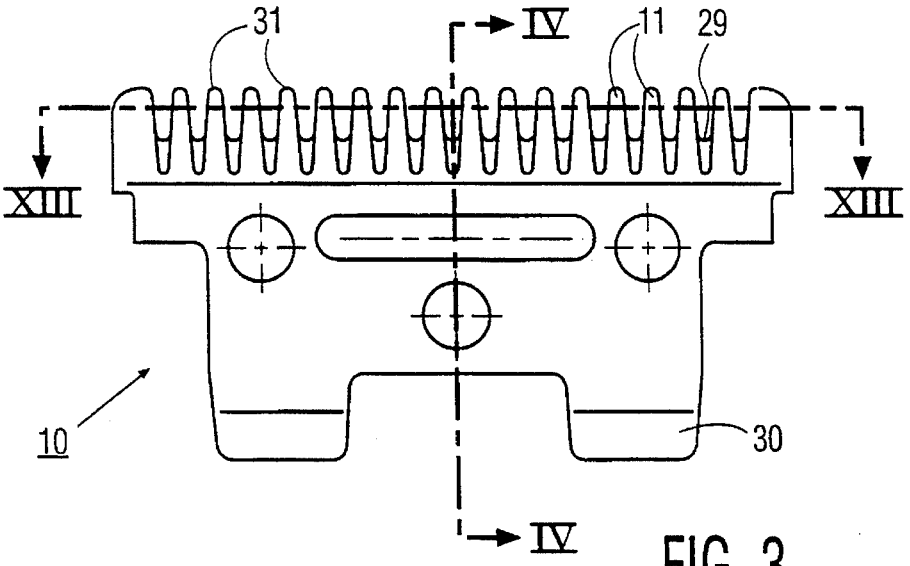
FIG. 3 is a plan view to a larger than full-size scale, showing a practical variant of a stationary toothed cutter of a toothed cutting device as shown in FIG. 2.
Figure 4:
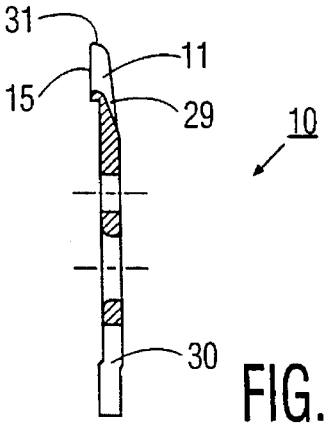
FIG. 4 shows the toothed cutter of FIG. 3 in a sectional view taken on the line IV—IV in FIG. 3.

FIGS. 3 and 4 show a practical variant of a stationary toothed cutter 10. As is apparent from FIGS. 3 and 4 this stationary toothed cutter 10 is offset both at the location of the row of cutter teeth 11, i.e. substantially in the proximal tooth area 29, and in the area 30 which is remote from the row of cutter teeth 11.

Figure 5:
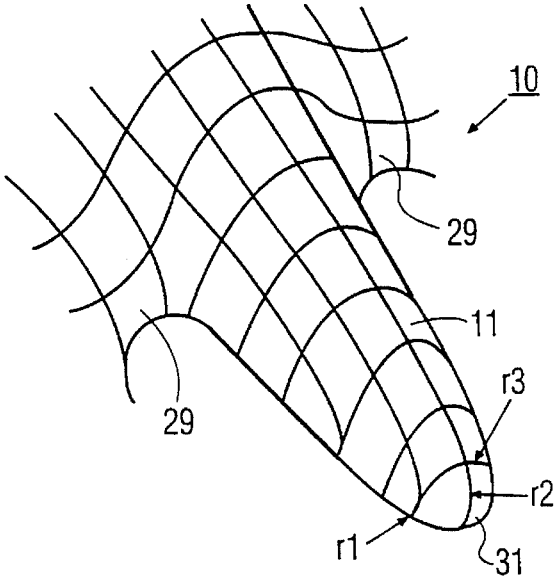
FIG. 5 shows a single cutter tooth of the stationary toothed cutter of FIGS. 3 and 4 in an oblique view to a substantially larger scale than FIGS. 3 and 4.

The stationary toothed cutter 10 in FIGS. 3 and 4 of a toothed cutting device 7 as shown in FIG. 2 has cutter teeth 11 which, as shown in detail in FIG. 5, are rounded at their distal ends 31 and 11 are now also wholly rounded over their entire tooth depth into the proximal tooth areas 29 except for the area of their shearing faces 15. This means that, in the first place, the cutter teeth 11 are rounded along lines of curvature situated in planes parallel to the shearing faces 15 of the cutter teeth 11, as is indicated by the radius r1 in FIG. 5, in the second place, the cutter teeth 11 are rounded along lines of curvature situated in planes which extend perpendicularly to the sheafing faces 15 and parallel to the tooth directions, as is indicated by the radius r2 in FIG. 5 and, in the third place, the cutter teeth 11 are rounded along lines of curvature situated in planes which extend perpendicularly to the shearing faces 15 and transversely of the tooth directions, as is indicated by the radius r3 in FIG. 5.

Although this is only shown for the cutter teeth 11 of the stationary toothed cutter 10 in FIGS. 3, 4 and in particularly 5 it will be apparent from FIG. 2 that the cutter teeth 13 of the reciprocable toothed cutter 12 are also wholly rounded over their entire tooth depth from their distal ends into the proximal tooth areas, except for the area of their shearing faces 16.

In a particularly advantageous manner the two toothed cutters 10 and 12 of the toothed cutting device 7 are formed by punched metal parts and the cutter teeth 11 and 13 of the two toothed cutters 10 and 12 are formed in an embossing process.

An advantageous method of manufacturing a toothed cutter for a toothed cutting device of a hair-cutting apparatus, i.e. for manufacturing for example a stationary toothed cutter 10 as shown in FIGS. 3 and 4, will now be described with reference to FIGS. 6 to 13.

Figure 6:
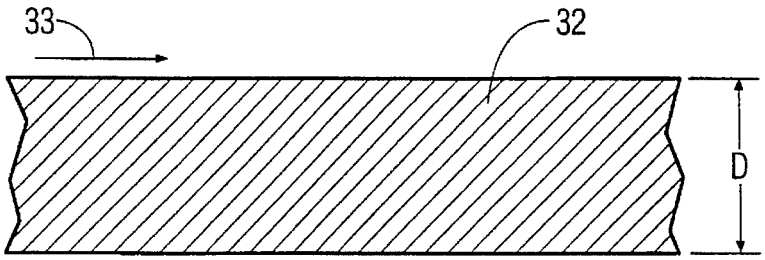
FIGS. 6 to 13 show diagrammatically the products obtained in the successive steps of a method in accordance with the invention of manufacturing a toothed cutter as shown in FIGS. 3 and 4 and partly the tools of a follow-on tool arrangement required for the manufacture of these products in sectional views taken on the line XIII—XIII in FIG. 3.

FIG. 6 is a cross-sectional view of an unhardened steel strip 32, whose transverse direction is indicated by an arrow 33 in FIG. 6. The steel strip 32 has a given strip thickness D of, for example, 1.0 mm. Such an unhardened steel strip 32 is moved stepwise to a follow-on tool arrangement positioned perpendicularly to its strip direction 33 and in this follow-on tool arrangement it is advanced in steps while at the same time the successive follow-on steps are carried out.

Figure 7:
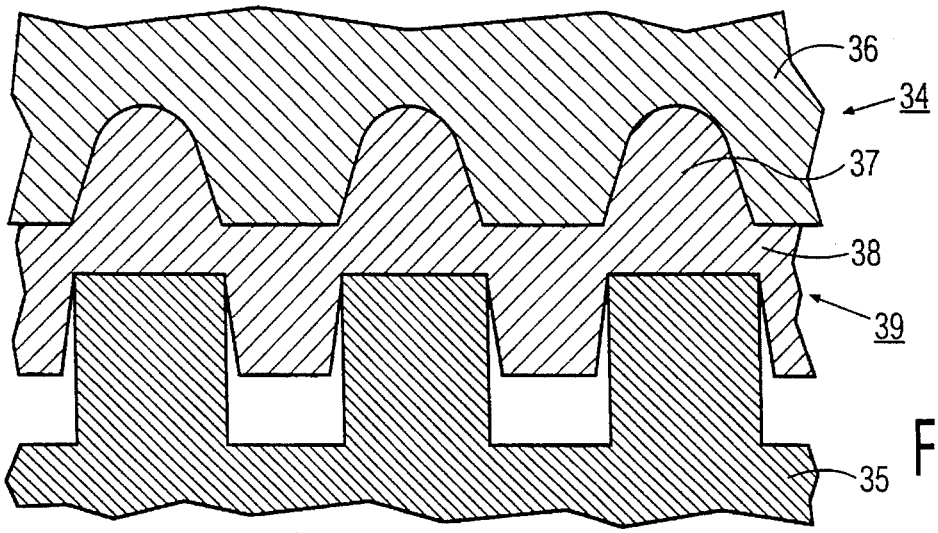
Figure 8:
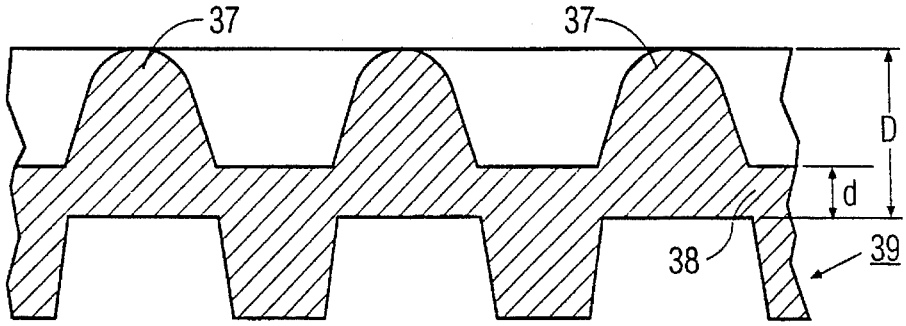

In a first follow-on step carried out in the follow-on tool arrangement, as shown diagrammatically in FIG. 7, the steel strip 32 is pre-embossed in an embossing device 34 comprising a lower die 35 and an upper die 36 to form pre-embossed first cutter-tooth blanks 37 of a toothed cutter, which pre-embossed first cutter-tooth blanks 37 remain connected to one another by steel-strip bridges 38 formed during pre-embossing and having a small bridge thickness d in relation to the strip thickness D of the steel strip 32. This pre-embossing operation is represented diagrammatically in FIG. 7. FIG. 8 shows the intermediate product 39 formed during the pre-embossing operation illustrated in FIG. 7. As is apparent from FIGS. 7 and 8 a steel-strip bridge 38 having a bridge thickness d equal to approximately 30% of the strip thickness D is formed during pre-embossing in the first follow-on step.

Figure 9:
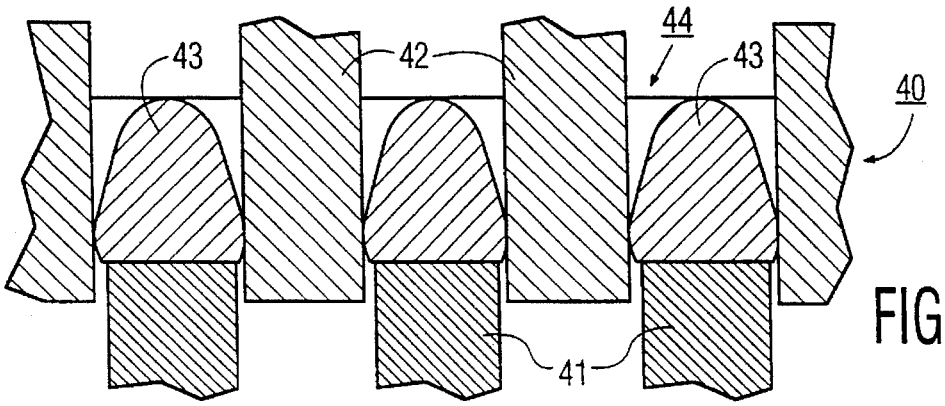
Figure 10:
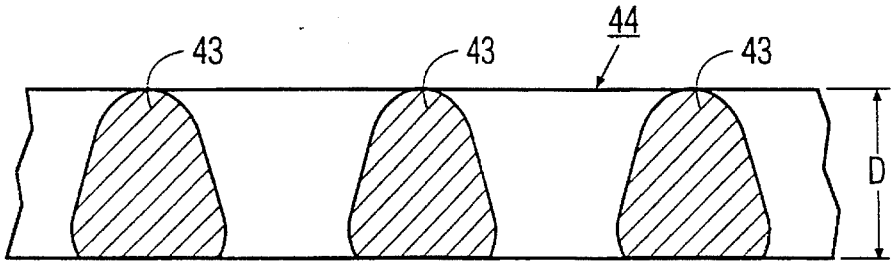
Figure 11:
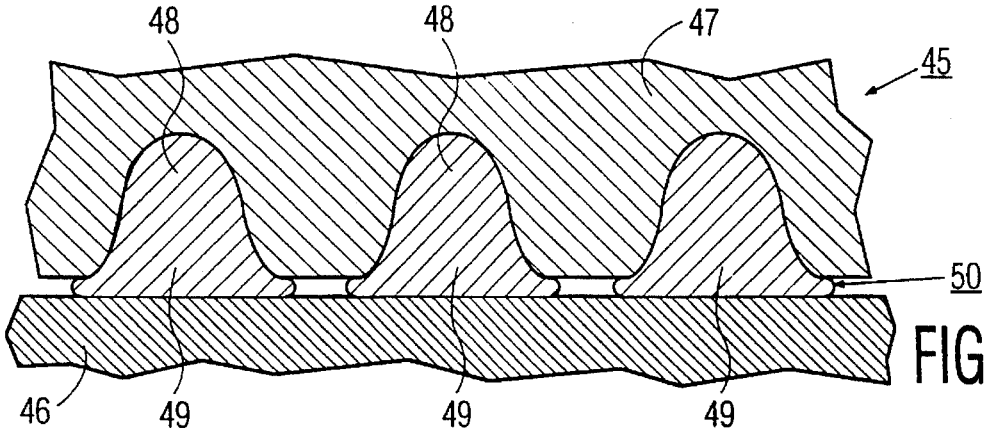

In a second follow-on step after pre-embossing in the first follow-on step the strip-steel bridge 38 connecting the pre-embossed cutter-tooth blanks 37 is cut away by means of a cutting device 40 comprising a die plate 41 and a cutting die 42 in a cutting operation and at the same time second cutter-tooth blanks 43 of a cutter are formed from the first cutter-tooth blanks 37, as is shown diagrammatically in FIG. 9. FIG. 10 shows the intermediate product 44 obtained in the second follow-on step illustrated in FIG. 9.

Figure 12:
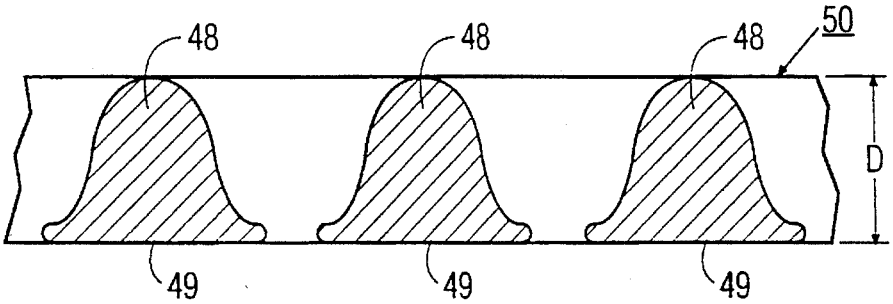
Figure 13:
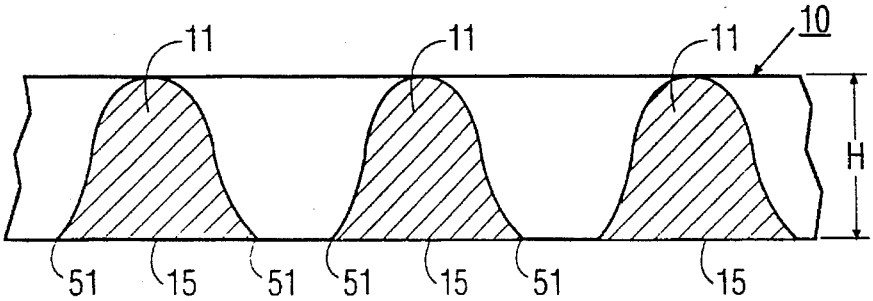

In a third follow-on step after the second follow-on step in the follow-on tool arrangement the second cutter-tooth blanks 43 are subjected to post-embossing in a further embossing device 45 comprising a lower die 46 and an upper die 47 to produce third cutter-tooth blanks 48 of a cutter. During this post-embossing in the third follow-on step in the follow-on tool arrangement are wholly rounded over their entire tooth depth from their distal ends into the proximal tooth areas except for the areas 49 intended for the formation of the shearing faces of the cutter teeth. This is simply achieved by means of a correspondingly rounded shape of the embossing zones in the upper die 47 of the further embossing device 45. FIG. 12 shows the intermediate product, i.e. the resulting cutter blank 50, obtained in the post-embossing operation illustrated in FIG. 11.

The cutter blank 50 shown in FIG. 12 including its third cutter-tooth blanks is subsequently hardened in a further process step, which can be effected by means of generally known technologies.

Subsequently, the hardened cutter blank 50 is conveyed to a grinding device, not shown, in which in a further process step the third cutter-tooth blanks 48 of a cutter are ground to form well-defined shearing faces 15 and sharp cutting edges 51 in the area intended for the formation of the shearing faces of the cutter teeth. This grinding operation yields the cutter teeth 11 of the toothed cutter thus manufactured, which teeth, shown in FIG. 13, have an overall height H slightly smaller than the original strip thickness D of the steel strip 32. After the grinding operation for grinding the shearing faces 15 the method of manufacturing the toothed cutter 10 is in principle finished. Instead of a grinding operation a lapping operation may be used to form the well-defined sheafing faces 15.

In a toothed cutting device having wholly rounded cutter teeth as described for the above exemplary embodiment it is achieved in a very simple manner that the cutter teeth, apart from their sharp cutting edges, have no sharp edges at all, so that when a toothed cutting device having toothed cutters with such wholly rounded cutter teeth is moved over the skin scratching, nicking and irritation of the skin is not possible. In this way a gentle cutting performance is always guaranteed.

A basic advantage of a method of manufacturing toothed cutters having wholly rounded cutter teeth, as described hereinbefore, is that the wholly rounded shape of the cutter teeth is obtained in a particularly simple manner by pre-embossing and, after an intermediate punching operation, post-embossing of the cutter teeth. Such wholly rounded cutter teeth can be manufactured particularly simply by an embossing process. Such an embossing process is also advantageous because such an embossing process enables to be provided with a comparatively wide range of cutting angles for the cutting edges of the cutter teeth.

The invention is not limited to the exemplary embodiment described above. The hair-cutting apparatus may alternatively be a shaving apparatus comprising a toothed cutting device similar to that in the exemplary embodiment described above. The steps in accordance with the invention may, for example, also be applied to so-called hair trimmers or beard trimmers which have a substantially elongate bar-shaped housing provided with a toothed cutting device in at least the upper part of the housing. Such apparatuses are disclosed in, for example, EP-A1-0,325,326 and U.S. Pat. No. 5,054,199.

We claim:

1. A hair-cutting apparatus having a toothed cutting device comprising a stationary cutter with at least one row of cutter teeth and a reciprocatingly drivable cutter with at least one row of cutter teeth, the cutter teeth having shearing faces and the two cutters being in engagement with one another by at least a part of the shearing faces of their cutter teeth, and the cutter teeth of at least one of the two cutters being rounded at their distal ends except for the area of their shearing faces, characterized in at least one cutter has cutter teeth which are wholly rounded at their distal ends and are in addition wholly rounded over their entire contour except for the area of their shearing faces.

2. An apparatus as claimed in claim 1, wherein the cutter teeth of both cutters are wholly rounded over their entire contour except for the area of their shearing faces.

3. An apparatus as claimed in claim 2 wherein both cutters are formed by punched metal parts and the cutter teeth are rounded in an embossing process.

4. A method of manufacturing a cutter for the toothed cutting device of the apparatus as claimed in claim 2 wherein an unhardened steel strip having a given strip thickness (D) is moved stepwise to a follow-on tool arrangement and in a first follow-on step the steel strip is pre-embossed to form pre-embossed first cutter-tooth blanks of the cutter, which pre-embossed first cutter-tooth blanks remain connected to one another by steel-strip bridges formed during pre-embossing and having small bridge thicknesses (d) in relation to the strip thickness (D) and subsequently in a second follow-up step the strip-steel bridges connecting the pre-embossed first cutter-tooth blanks are cut away in a cutting operation and at the same time second cutter-tooth blanks of the cutter are formed from the first cutter-tooth blanks, and subsequently in a third follow-on step the second cutter-tooth blanks are post-embossed to produce post-embossed third cutter-tooth blanks of the cutter, during which post-embossing the third cutter-tooth blanks are embossed so as to be wholly rounded over their entire contour except for the areas intended for the formation of the shearing faces of the cutter teeth.

5. An apparatus as claimed in claim 1 wherein both cutters are formed by punched metal parts and the cutter teeth are rounded in an embossing process.

6. A method of manufacturing a cutter for the toothed cutting device of the apparatus as claimed in claim 3 wherein an unhardened steel strip having a given strip thickness (D) is moved stepwise to a follow-on tool arrangement and in a first follow-on step the steel strip is pre-embossed to form pre-embossed first cutter-tooth blanks of a cutter, which pre-embossed first cutter-tooth blanks remain connected to one another by steel-strip bridges formed during pre-embossing and having small bridge thicknesses (d) in relation to the strip thickness (D), and subsequently in a second follow-up step the strip-steel bridges connecting the pre-embossed first cutter-tooth blanks are cut away in a cutting operation and at the same time second cutter-tooth blanks of the cutter are formed from the first cutter-tooth blanks, and in subsequently in a third follow-on step the second cutter-tooth blanks are post-embossed to produce post-embossed third cutter-tooth blanks of the cutter, during which post-embossing the third cutter-tooth blanks are embossed so as to be wholly rounded over their entire contour except for the areas intended for the formation of the shearing faces of the cutter teeth.

7. A method of manufacturing a cutter for the toothed cutting device of the apparatus as claimed in claim 1 wherein an unhardened steel strip having a given strip thickness (D) is moved stepwise to a follow-on tool arrangement and in a first follow-on step the steel strip is pre-embossed to form pre-embossed first cutter-tooth blanks of the cutter, which pre-embossed first cutter-tooth blanks remain connected to one another by steel-strip bridges formed during pre-embossing and having a small bridge thickness (d) in relation to the strip thickness (D), and subsequently in a second follow-on step the strip-steel bridges connecting the pre-embossed first cutter-tooth blanks are cut away in a cutting operation and at the same time second cutter-tooth blanks of the cutter are formed from the first cutter-tooth blanks, and subsequently in a third follow-on step the second cutter-tooth blanks are post-embossed to produce post-embossed third cutter-tooth blanks of the cutter, during which post-embossing the third cutter-tooth blanks are embossed so as to be wholly rounded over their entire contour except for the areas intended for the formation of the shearing faces of the cutter teeth.

8. A method as claimed in claim 7, wherein steel-strip bridges having a bridge thickness (d) equal to at the most 75% of the strip thickness (D) are formed during pre-embossing in the first follow-on step.

9. A method as claimed in claim 8, wherein steel-strip bridges having a bridge thickness (d) equal to at the most 30% of the strip thickness (D) are formed during pre-embossing in the first follow-on step.

10. A method as claimed in claim 9 wherein after the third follow-on step in the follow-on tool arrangement the resulting cutter blank including its third cutter-tooth blanks is hardened in a further process step.

11. A method as claimed in claim 9 wherein the third cutter-tooth blanks of the cutter are ground to form well-defined shearing faces and sharp cutting edges in the area intended for the formation of the shearing faces of the cutter teeth.

12. A method as claimed in claim 8 wherein after the third follow-on step in the follow-on tool arrangement the resulting cutter blank including its third cutter-tooth blanks is hardened in a further process step.

13. A method as claimed in claim 8 wherein the third cutter-tooth blanks of the cutter are ground to form well-defined shearing faces and sharp cutting edges in the area intended for the formation of the shearing faces of the cutter teeth.

14. A method as claimed in claim 4 wherein after the third follow-on step in the follow-on tool arrangement the resulting cutter blank including its third cutter-tooth blanks is hardened in a further process step.

15. A method as claimed in claim 14 wherein the third cutter-tooth blanks of the cutter are ground to form well-defined shearing faces and sharp cutting edges in the area intended for the formation of the shearing faces of the cutter teeth.

16. A method as claimed in claim 4 wherein the third cutter-tooth blanks of the cutter are ground to form well-defined shearing faces and sharp cutting edges in the area intended for the formation of the shearing faces of the cutter teeth.

* * * * *